US010676334B2

(12) United States Patent
Pithoud

(10) Patent No.: US 10,676,334 B2
(45) Date of Patent: Jun. 9, 2020

(54) ANTI-POTHOLE AERIAL WORK PLATFORM

(71) Applicant: HAULOTTE GROUP, L'Horme (FR)

(72) Inventor: Emmanuel Pithoud, Saint-Marie-de-Cuines (FR)

(73) Assignee: HAULOTTE GROUP, L'Horme (FR)

( * ) Notice: Subject to any disclaimer, the term of this patent is extended or adjusted under 35 U.S.C. 154(b) by 0 days.

(21) Appl. No.: 15/567,369

(22) PCT Filed: Apr. 15, 2016

(86) PCT No.: PCT/FR2016/050893
§ 371 (c)(1),
(2) Date: Oct. 17, 2017

(87) PCT Pub. No.: WO2016/170255
PCT Pub. Date: Oct. 27, 2016

(65) Prior Publication Data

US 2018/0162708 A1 Jun. 14, 2018

(30) Foreign Application Priority Data

Apr. 18, 2015 (FR) ..... 15 53476

(51) Int. Cl.
*B66F 11/04* (2006.01)
*B66F 17/00* (2006.01)
*E04G 1/22* (2006.01)

(52) U.S. Cl.
CPC ..... *B66F 11/042* (2013.01); *B66F 17/006* (2013.01); *E04G 1/22* (2013.01)

(58) Field of Classification Search
CPC .. B66F 11/042; B66F 17/006; F15B 15/1423; E04G 1/22; E04G 1/24; E04G 2001/242; E04G 2001/244; E04G 5/00
See application file for complete search history.

(56) References Cited

U.S. PATENT DOCUMENTS 5,318,374 A * 6/1994 Rumberger ..... F16B 4/006 403/277
5,890,737 A 4/1999 Hutka
(Continued)

FOREIGN PATENT DOCUMENTS

CA 2646412 A1 7/2009
CN 201206097 Y 3/2009
(Continued)

*Primary Examiner* — Katherine W Mitchell
*Assistant Examiner* — Shiref M Mekhaeil
(74) *Attorney, Agent, or Firm* — 24IP Law Group USA, PLLC; Timothy R DeWitt

(57) ABSTRACT

The invention relates to an aerial work platform including: a frame (1) mounted on wheels (4, 5); a work platform (3) mounted on a lifting mechanism (2); two side bars (10) arranged under the frame and movable relative to said frame between: either a raised position, and/or a lowered position in which said bars extend past the frame toward the ground; and an actuator (30) assigned solely to actuating the two bars to move said bars between these two positions, the actuator having two opposite ends by means of which said actuator moves the two bars by varying the distance between the two ends. The actuator moves each of the two bars by means of another of the two ends and is maintained only by the two ends. This actuation device is particularly simple, compact, and cost effective.

20 Claims, 6 Drawing Sheets

(56) References Cited

U.S. PATENT DOCUMENTS 6,425,459 B1 * 7/2002 Keefer ..... B66F 11/042 182/141
6,586,854 B1 * 7/2003 Nozawa ..... G09B 9/04 310/83
6,985,795 B2 * 1/2006 Scotese ..... B60G 9/02 212/278
8,205,315 B2 * 6/2012 Mullen ..... F16C 7/026 280/93.511
8,267,222 B2 * 9/2012 Cui ..... B66F 11/042 182/69.5
9,222,493 B2 * 12/2015 Riskas ..... F15B 21/085
9,914,626 B2 * 3/2018 Shugen ..... B66F 9/205
2002/0030311 A1 * 3/2002 Beck ..... B60G 17/0416 267/64.11
2002/0185850 A1 * 12/2002 Puszkiewicz ..... B66F 17/003 280/755
2005/0224290 A1 * 10/2005 Sannah ..... B66F 11/042 182/141
2008/0190104 A1 * 8/2008 Bresie ..... F15B 7/006 60/476
2008/0231076 A1 * 9/2008 Plavetich ..... B60R 3/02 296/183.1
2009/0174176 A1 * 7/2009 Cui ..... B66F 17/003 280/755
2009/0273159 A1 * 11/2009 Sutton ..... B60G 3/06 280/419
2010/0116590 A1 * 5/2010 Rund ..... B60R 3/02 182/127
2012/0145480 A1 * 6/2012 Willis ..... E06C 5/06 182/106
2012/0181109 A1 * 7/2012 Rund ..... B60R 3/02 182/97
2014/0366522 A1 * 12/2014 Masutani ..... F15B 15/18 60/477
2016/0047472 A1 * 2/2016 Braun ..... F15B 15/1428 92/170.1
2017/0137271 A1 * 5/2017 Shugen ..... B66F 11/04
2018/0022591 A1 * 1/2018 Xu ..... B66F 11/042
2018/0044892 A1 * 2/2018 Nishide ..... E02F 9/24

FOREIGN PATENT DOCUMENTS

EP 0 831 054 A2 3/1998
EP 0831054 A2 3/1998
JP 2009 143676 A 7/2009
JP 2009143676 7/2009
KR 100 942 593 B1 2/2010
KR 100942593 B1 2/2010
WO 2002100761 12/2002
WO 2005068347 7/2005
WO 2005068347 A1 7/2005
WO 2013059243 4/2013

* cited by examiner

ANTI-POTHOLE AERIAL WORK PLATFORM

The present invention relates to the field of mobile personnel lifting platforms, also commonly referred to as aerial work platforms. It relates more particularly to aerial work platforms with wheels by means of which the aerial work platform is supported on the ground and movable thereon.

Aerial work platforms are machines intended to enable one or more persons to work at a height. They comprise a chassis, a work platform and a mechanism for lifting the work platform. The work platform comprises a deck surrounded by a guardrail. It is designed to receive one or more persons and optionally also loads such as tools or other equipment, and materials such as paint, cement, etc. The work platform is supported by the lifting mechanism, which is mounted on the chassis. In this case, the chassis rests on the ground by means of the aforementioned wheels. The lifting mechanism makes it possible to raise the work platform from a position lowered on the chassis to the required working height, generally by means of one or more hydraulic cylinders. The drive for moving the aerial work platform on the ground is generally mounted directly on the chassis. This is the case also with the hydraulic unit supplying the aforementioned cylinder(s), but it may also be mounted—when it comprises one—on the turret of the lifting mechanism that is mounted pivotably on the chassis in order to make it possible to change the orientation of the lifting mechanism and therefore of the work platform.

There exist several types of lifting mechanism for the work platform according to which the aerial work platforms are named. The invention relates especially, but without being limited thereto, to scissor-type aerial work platforms and vertical-mast aerial work platforms.

With regard to scissor-type aerial work platforms, the lifting mechanism comprises beams articulated at their centre like scissors, these scissor mechanisms being mounted one above the other via their ends which are pivotably connected in order to reach the required working height. FIGS. 1 and 2 illustrate an example of a scissor-type aerial work platform: the chassis is referenced 1, the scissor lifting mechanism 2, the work platform 3, the front wheels 4, the rear wheels 5 and the hydraulic cylinder actuating the work platform lifting mechanism 6. Depending on the models concerned, the maximum working height generally varies between 6 and 18 metres.

With regard to vertical-mast aerial work platforms, the lifting mechanism is designed in the form of an extensible mast comprising vertical parts sliding on one another in order to extend vertically to the required working height. Their lifting mechanism sometimes comprises a turret on which the sliding vertical parts are mounted, the turret being mounted pivotably on the chassis about a vertical axis in order to be able to vary the orientation of the work platform with respect to the chassis. The work platform is mounted on the highest vertical part sometimes by means of a pendular arm—that is to say an arm articulated on the vertical mast about a horizontal axis—in order to give more flexibility to the user in reaching the working position. Depending on the models concerned, the maximum working height varies generally between 6 and 12 metres.

These two types of aerial work platform have the common feature of presenting an increased risk of tipping when they move on the ground while their work platform is raised. This risk is liable to occur when one of the wheels travels in a pothole in the ground or mounts a projection such as a kerb.

This risk relates in particular to the fact that their chassis is relatively narrow and their wheels have small dimensions, unlike other types of aerial work platforms having a wide chassis and larger wheels, as is the case with articulated aerial work platforms and telescopic aerial work platforms, which are generally designed for exclusively outdoor use and to reach greater heights, which may range up to more than 40 metres.

To limit the risk of the aerial work platform tipping, arranging, under the chassis, side bars commonly referred to as pothole-protection bars, is known. More precisely, such a bar is arranged under the chassis, on each side, and extends horizontally over substantially the entire length between the front wheel and the rear wheel. A device automatically moves these two bars between a raised position, referred to as the inactive position, and a lowered position, referred to as the active position. One of these two bars—referenced 10—is visible in FIG. 2, where it is in the lowered position, while they are not visible in FIG. 1 since they are in the raised position under the chassis 1.

When the work platform is lowered on the chassis, the risk that the aerial work platform may tip is non-existent and the bars are in the raised position. In this case, the ground clearance is sufficiently great to enable the aerial work platform, when it moves, to pass over obstacles such as potholes or kerbs without the chassis contacting the ground.

When the work platform is raised, the bars are in the lowered position. The ground clearance is then substantially reduced. If a wheel of the aerial work platform runs in a pothole, the adjacent bar contacts the ground around the pothole. Consequently, the inclination of the chassis of the aerial work platform is limited, thus preventing its tipping over.

There exist mainly two technological approaches for making the device automatically moving the bars between their raised position and their lowered position.

A first approach consists of using a mechanical connection between the mechanism for lifting the work platform and the bars, as well as springs. The energy for actuating the work platform lifting mechanism is used to move the bars from the raised position to the lowered position. Examples of this approach are described by U.S. Pat. No. 6,425,459 B1, WO 2005/068347 A1 and CA 2 646 412 A1. These solutions are however, mechanically complex, all the more so since they must comprise a system for locking the bars in their lowered position in order to maintain this position if an external force tending to make them return to the raised position is applied to them.

The second approach consists of using actuators allocated solely to the actuation of the bars; they are therefore independent of the actuator or actuators of the mechanism for lifting the work platform. Each bar is actuated by a respective actuator for moving it from the raised position to the lowered position and vice versa according in particular to the signal from a position sensor detecting whether the work platform is in the lowered position or not.

FIG. 3 illustrates this approach as implemented on machines in the Optimum range marketed by the applicant. Each bar 10 is secured, towards each of its longitudinal ends, to a support 11 that is mounted pivotably on the chassis 1 about a shaft 12. The bars 10 pass from the raised position to the lowered position and vice versa by pivoting about the shafts 12. Each bar 10 is moved between these two positions by a corresponding hydraulic cylinder 13, the rod of which is mounted in pivot connection on the support 11 about a shaft 14 and the body of which is mounted in pivot connection on the chassis about a shaft 15. This solution is simpler than those of the first approach and provides reliable protection against the tilting of the aerial work platform, but does however remain expensive because of the cost of the cylinders.

US 2002/0185850 A1 discloses another implementation of this second approach. Each bar is mounted therein on the chassis by a first pair of links articulated on each other forming a first toggle-joint mechanism and a second pair of links articulated on each other forming a second toggle-joint mechanism. When the two toggle-joint mechanisms are folded, the bar is in the raised position while the bar is in the lowered position when the toggle-joint mechanisms are in the unfolded position. An actuator specific to each bar is mounted between the two toggle-joint mechanisms in order to move them from the folded position to the unfolded position and vice versa. In the unfolded position, the links of the toggle-joint mechanisms are placed in abutment beyond the position of alignment of their axes. In this way, the forces external to the aerial work platform applied to the bars in the lowered position and which urge them towards the raised position—which may correspond to the weight of the aerial work platform—are countered by the toggle-joint mechanisms, rather than by the actuators. Because of this, the force to be developed by the actuators is limited to that necessary for moving the toggle-joint mechanisms from the folded position to the unfolded position and vice versa. However, this solution is complex and expensive despite the fact of using more economical actuators.

EP 831 054 A2 also discloses another implementation of this second approach, but using only one hydraulic cylinder to actuate the two bars. For this purpose, the cylinder is mounted under the chassis and extends parallel halfway between the two bars, the body of the cylinder being fixed to the chassis while its rod pivotably actuates the two bars by means of a toggle-joint angle transmission mechanism that transforms the movement of the rod parallel to the bars into a movement perpendicular to the bars. Although using only one cylinder, this solution is despite everything complex and bulky because of the toggle-joint angle transmission mechanism.

Moreover, it is known to arrange under the chassis, just behind the front wheels and in front of the rear wheels, side bars for protection against potholes that are fixed and very short, in order to reduce the ground clearance only locally at the wheels. An example of this is given in WO 2013/059243 A1. Though this solution is simple and economical, it only moderately limits the risk of tipping of the aerial work platform. In addition, when it moves with the work platform lowered, the aerial work platform may become jammed on small irregularities on the ground, such as a tar joint present for example on door thresholds at the entrance to a building.

One aim of the present invention is to provide a technical solution for protection against potholes for aerial work platforms that at least partially overcomes the aforementioned drawbacks. According to one aspect, the invention aims to provide a solution that is both reliable while being simpler and economical.

To this end, the present invention proposes an aerial work platform comprising:

- a chassis mounted on wheels for movement of the aerial work platform on the ground;
- a work platform;
- a lifting mechanism mounted on the chassis and supporting the work platform for moving it in height;
- two side bars arranged under the chassis, each being able to move with respect to the chassis between:
  - a raised position; and
  - a lowered position in which the side bar projects beyond the chassis in the direction of the ground; and
- an actuator allocated solely to the actuation of the two side bars for moving them from the raised position to the lowered position and vice versa.

The lowered position of the side bars makes it possible to limit the risk that the aerial work platform may tip over if a wheel runs in a pothole when moving on the ground with the work platform raised. The fact that the actuator is allocated solely to the actuation of the two side bars is advantageous since, being distinct from the actuator or actuators of the mechanism for lifting the work platform, it avoids using a complex mechanical connection between the platform lifting mechanism and the side bars as is the case with the prior art using the first approach described above. Moreover, using a single actuator for actuating the two bars at the same time is more economical and limits the mounting operations compared with the prior art using two actuators as is the case with those using the second approach described above.

According to an advantageous aspect of the invention, the actuator has two opposite ends through which it actuates the two side bars by varying the distance between the two ends, the actuator acting on each of the two side bars through another of the two ends and the actuator being held only through the two ends. Because of this, the mechanism for actuating the bars is simpler, more economical and more compact compared with the teaching of EP 831 054 A2 mentioned above.

According to preferred embodiments, the invention comprises one or more of the following features:

- each of the bars is mounted on the chassis by means of connection elements and the actuator is held on the chassis solely through said connection elements;
- the bars are mounted on the chassis in a pivoting connection;
- the actuator urges each bar in the lowered position against a respective fixed stop of the chassis;
- in the combination of the two previous features, provision may be made for, in the lowered position, the bottom edge of each bar to be offset with respect to a vertical passing through the pivot axis so that the forces external to the aerial work platform that are exerted vertically upwards on the bottom edge of the bar are countered by the respective fixed stop of the chassis;
- the actuator urges the bars in the raised position against a fixed stop of the chassis;
- each bar is horizontal and extends between two side wheels substantially over the entire length separating the two side wheels;
- the actuator is a cylinder;
- the actuator is a hydraulic cylinder;
- the cylinder extends horizontally and perpendicular to the longitudinal direction of the chassis;
- the actuator opposes the forces external to the aerial work platform acting on the bars that tend to move them from the lowered position to the raised position;
- each of the two ends of the actuator is mounted, preferably in a pivot connection, on a respective one of the two bars or on a part on which a respective one of the two bars is secured;
- each of the two ends of the actuator is mounted in a pivot connection on a respective support to which another one of the two side bars is secured, the support being mounted pivotably on the chassis;
- each of the side bars is secured to the respective support towards one of its longitudinal ends, each of the side bars further being secured towards the other of its longitudinal ends to a second respective support mounted pivotably on the chassis;

the actuator actuates each of the two side bars through a respective locking mechanism, each locking mechanism having an unlocked position and a locked position, the actuator actuating the locking mechanisms for making them pass from their unlocked position to their locked position and vice versa, the passage to the unlocked position having the effect of moving the side bars into the raised position and the passage into the locked position having the effect of moving the bars into the lowered position, the locking mechanisms in the locked position countering, independently of the actuator, any force external to the aerial work platform exerted on the bars that tend to move them from the lowered position to the raised position;

the aerial work platform is a scissor-type aerial work platform or a vertical-mast aerial work platform.

Other aspects, features and advantages of the invention will emerge from a reading of the following description of a preferred embodiment of the invention, given by way of example and with reference to the accompanying drawing.

Figure 1:
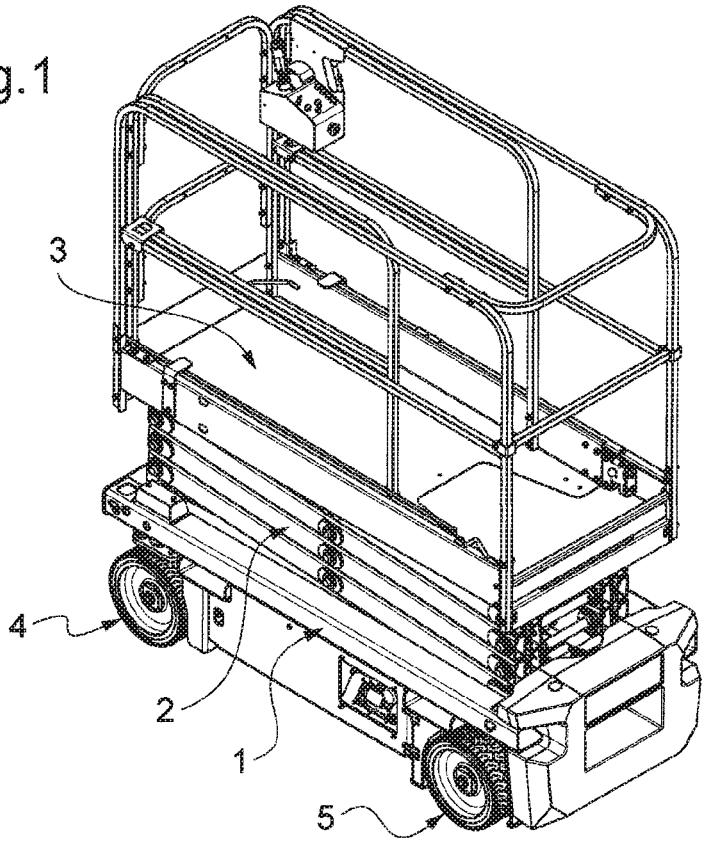
Fig.1 Prior Art
FIG. 1 shows a perspective view of a scissor-type aerial work platform with the work platform in the lowered position on the chassis, the aerial work platform having anti-pothole side bars that are not visible since they are in the raised position under the chassis.
Figure 3:
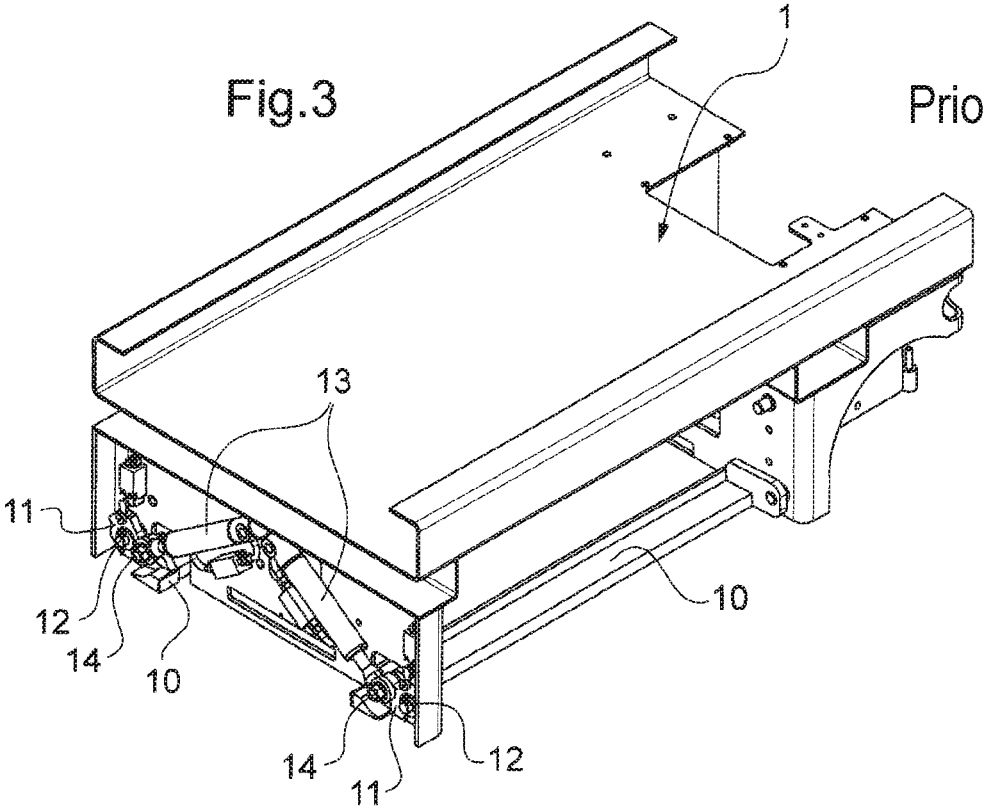
Fig.3 Prior Art
Figure 2:
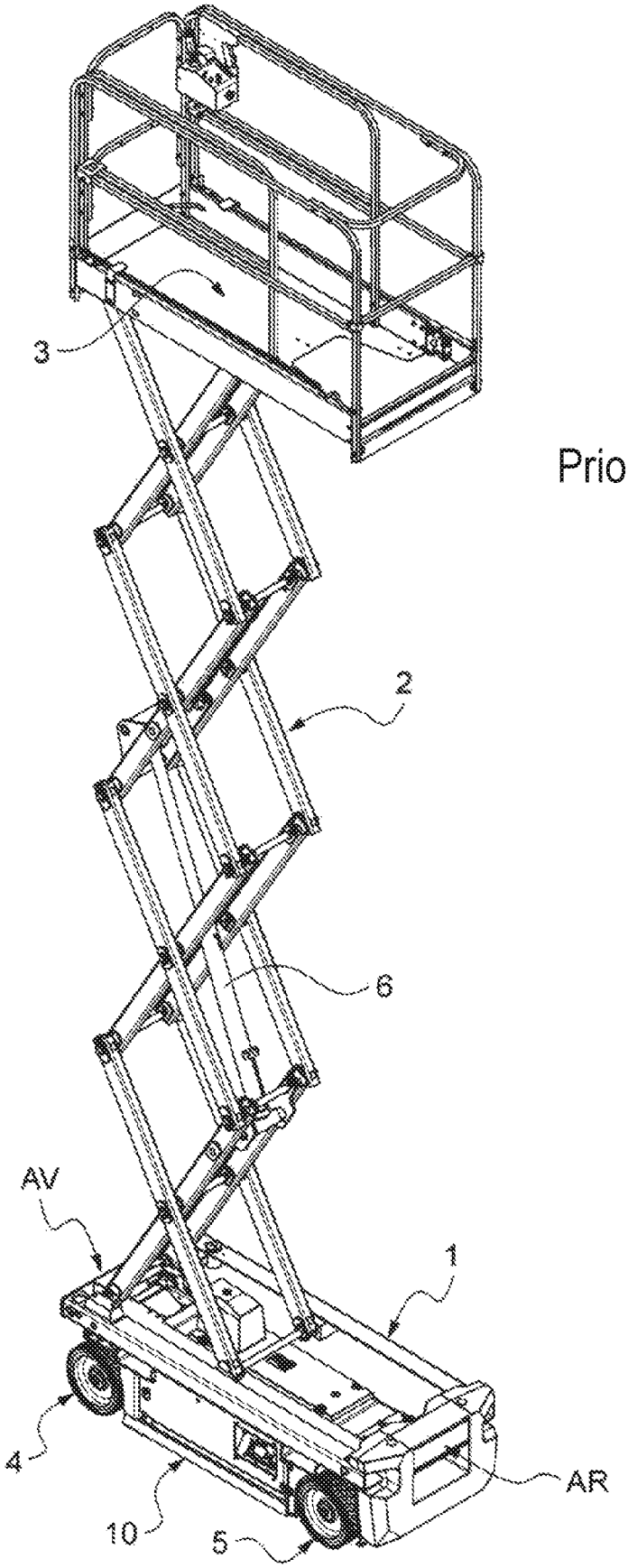
Prior Art Fig.2
FIG. 2 shows the same perspective view of the aerial work platform of FIG. 1, but with the work platform raised and the anti-pothole side bars in the lowered position (only one of which is visible).

FIG. 3 shows, for a scissor-type aerial work platform of FIGS. 1 and 2, the chassis and a system for actuating the anti-pothole side bars according to the prior art of the Optimum range of the applicant, the bars being in the raised position, it being stated that the part of the chassis corresponding to the front wheels is notionally omitted in order to render visible the system for actuating the anti-pothole side bars, which is situated at a level of the chassis a little to the rear of the front wheels.

Figure 4:
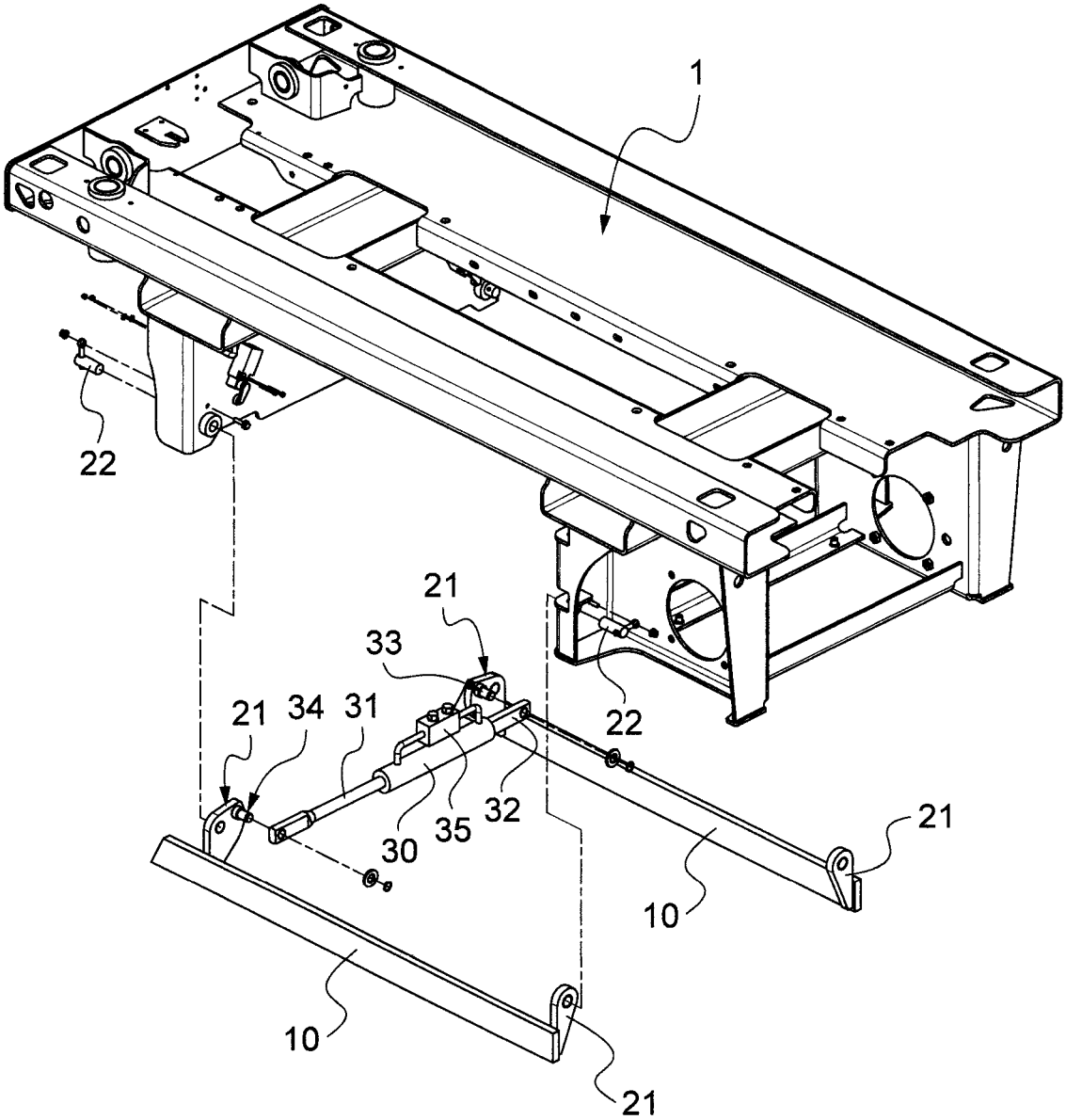

FIG. 4 shows, for a scissor-type aerial work platform of FIGS. 1 and 2, an exploded view of the chassis and of the system for actuating the side bars according to a preferred embodiment of the invention.

Figure 5:
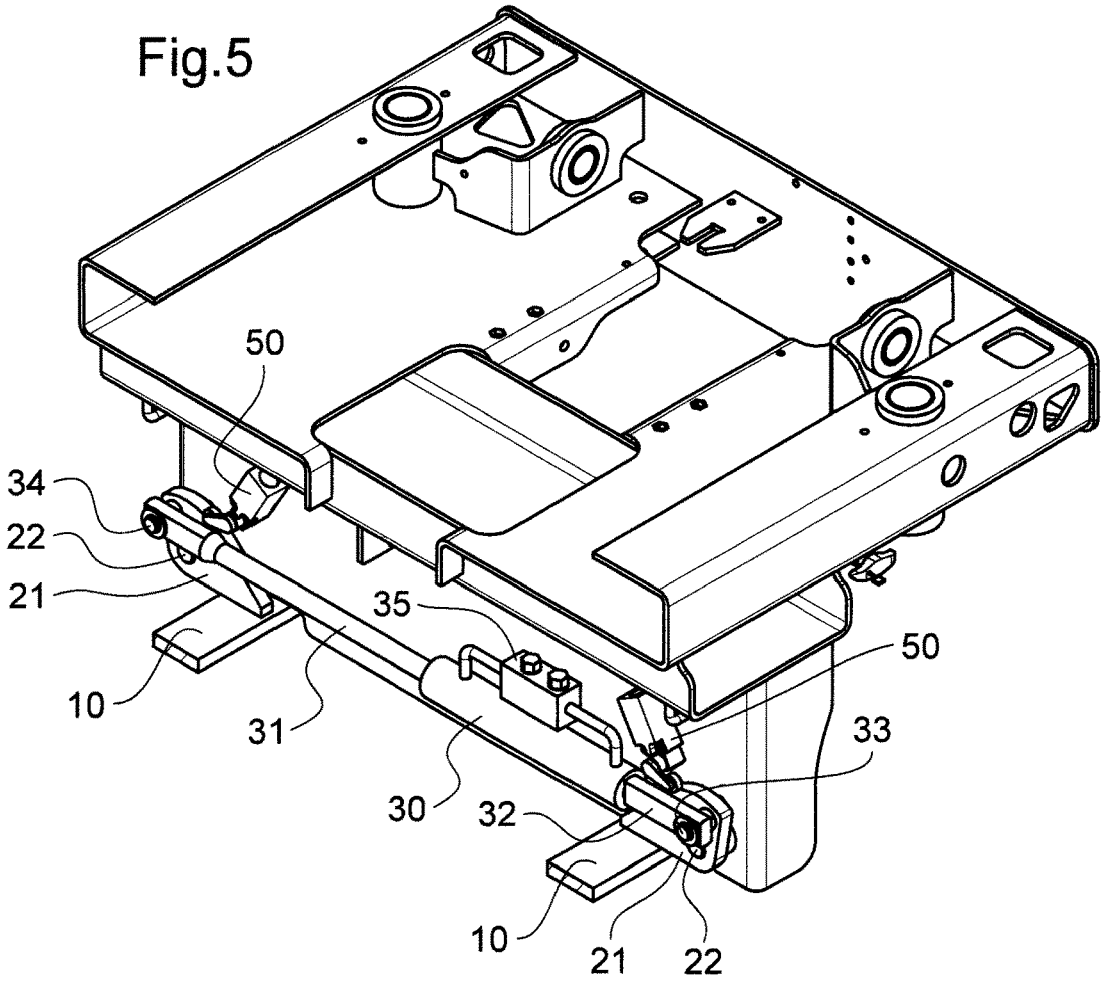
Figure 6:
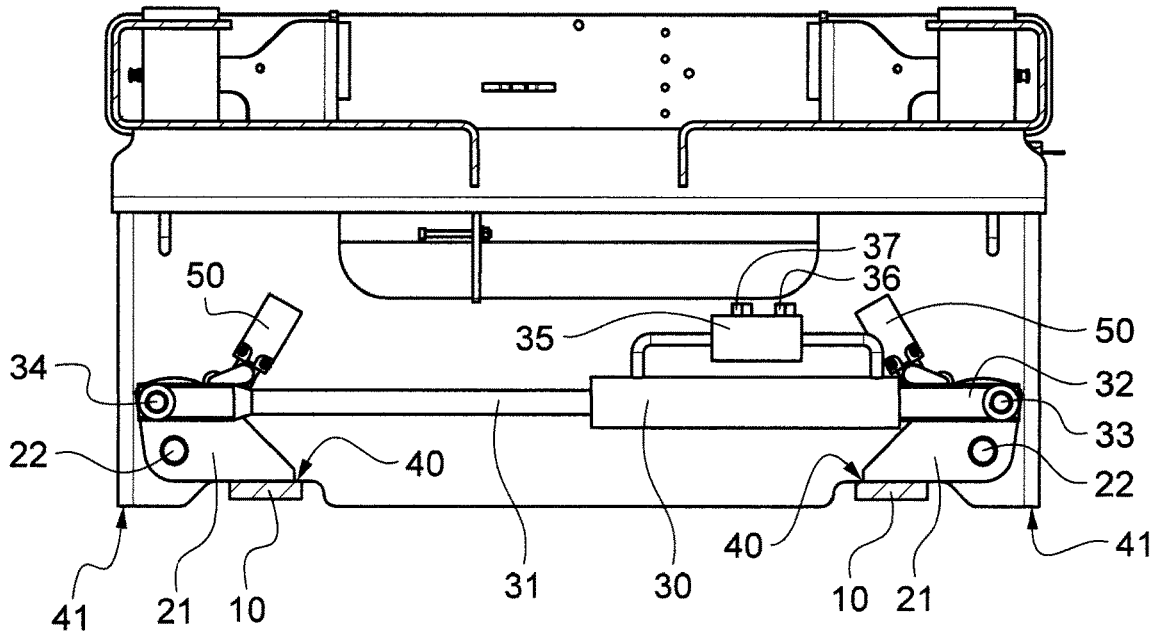

FIGS. 5 and 6 show respectively a perspective view and a front view of the chassis and of the system for actuating the anti-pothole side bars, the bars being in the raised position, it being stated that a part of the chassis is notionally omitted in order to render visible the system for actuating the anti-pothole side bars.

Figure 7:
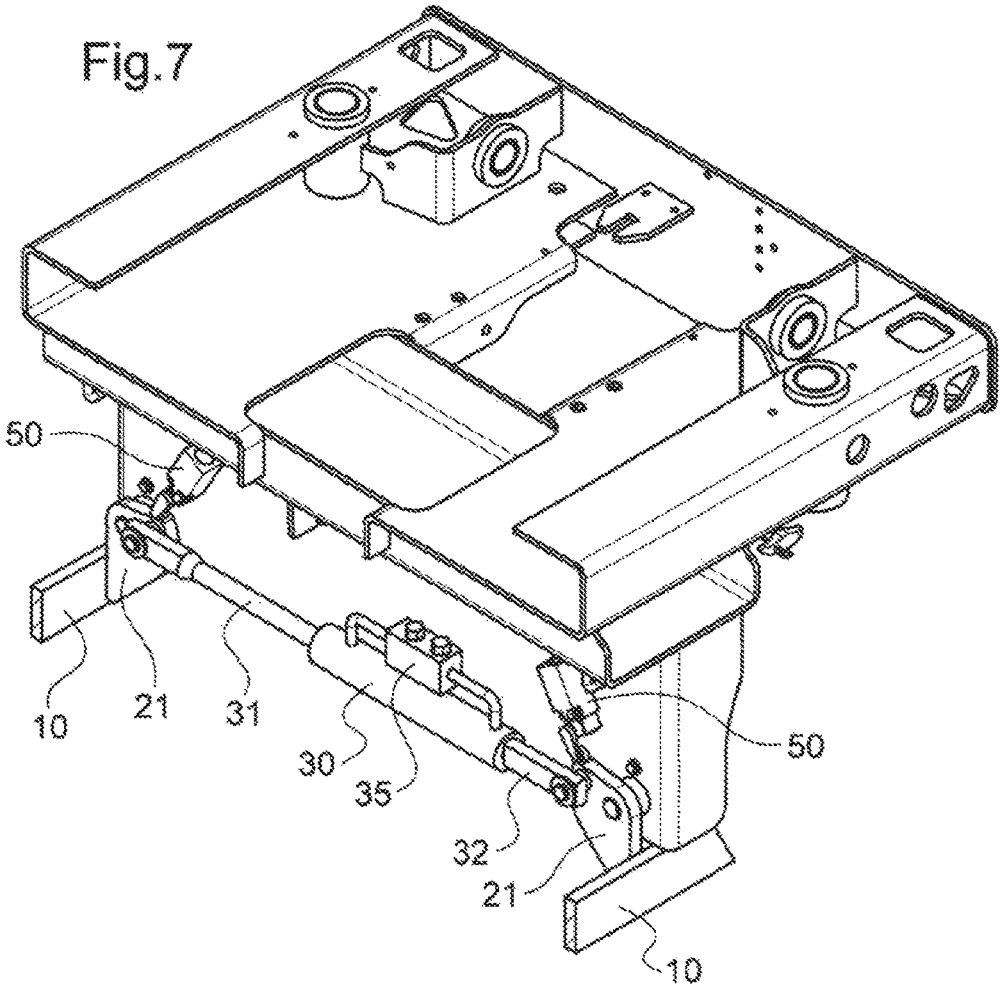
Figure 8:
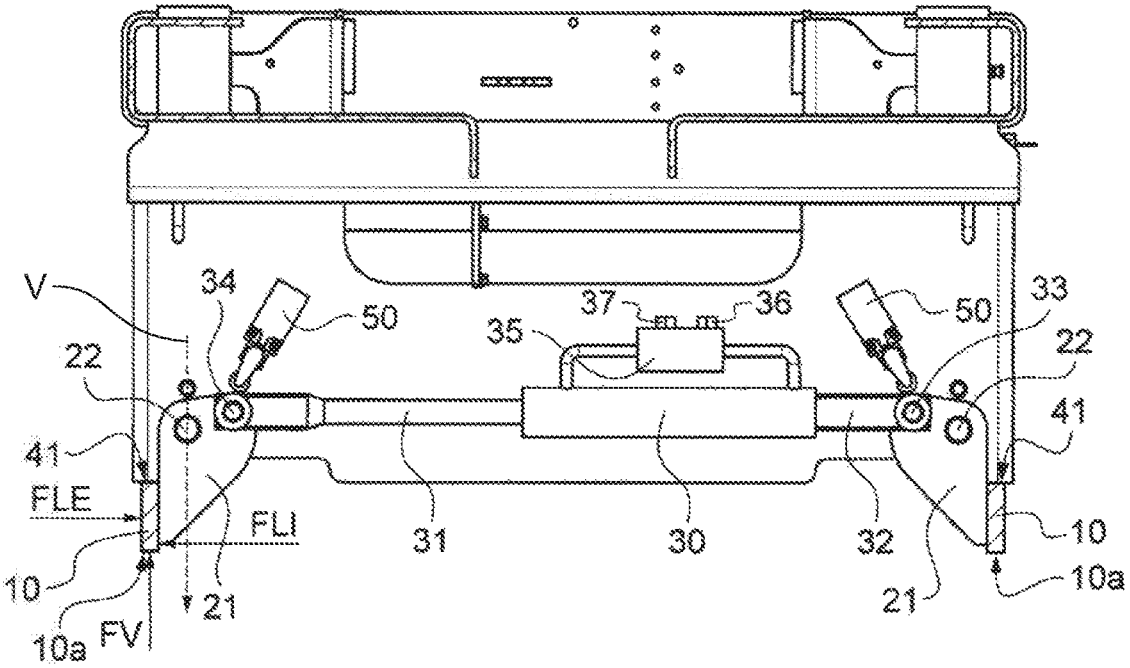

FIGS. 7 and 8 are similar to FIGS. 5 and 6, but with the anti-pothole side bars in the lowered position.

Figure 9:
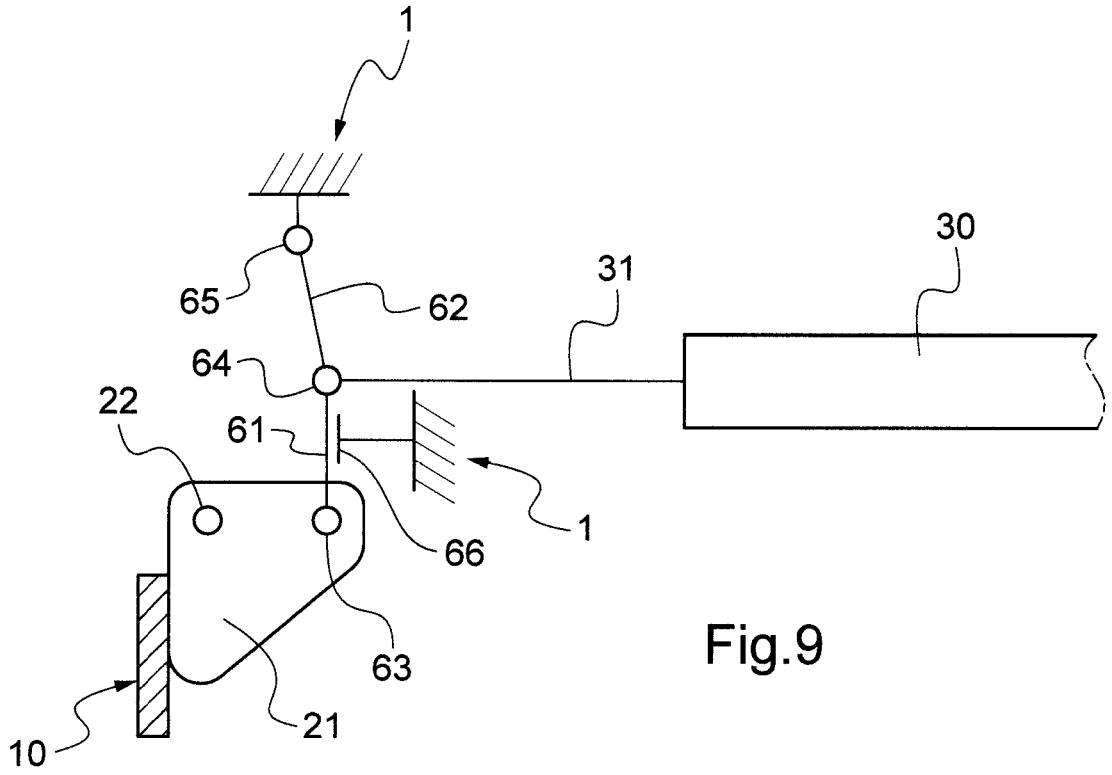
Figure 10:
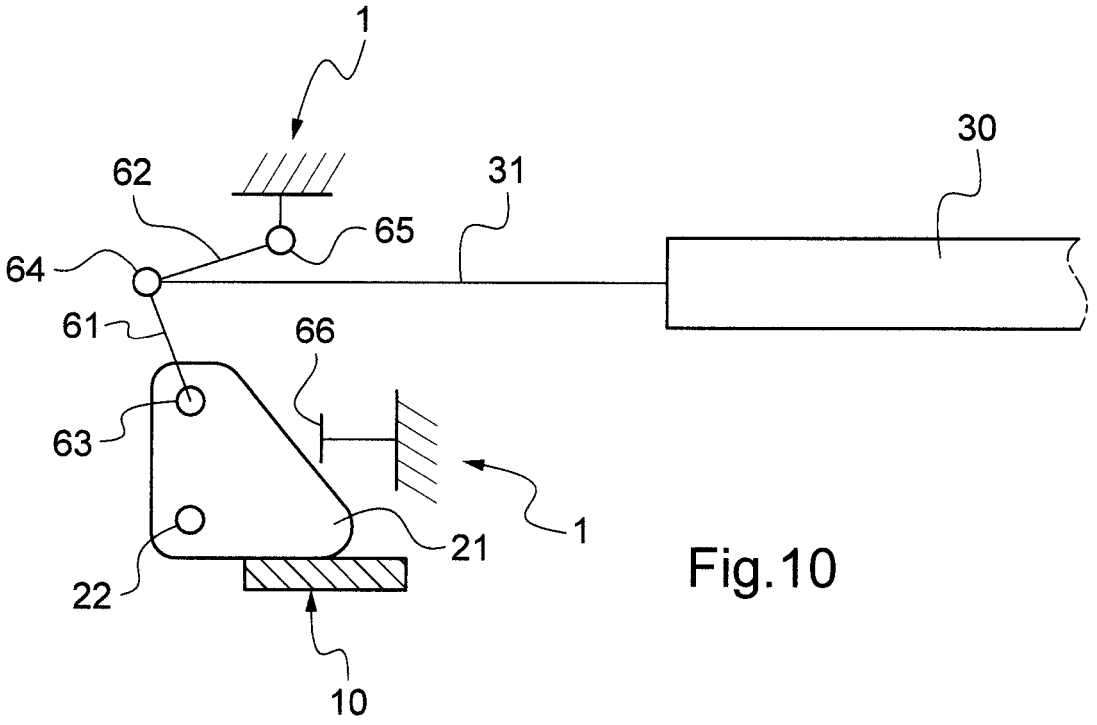

FIGS. 9 and 10 show schematically a variant according to the invention of the system for actuating the anti-pothole side bars, the bars being in the lowered position and in the raised position respectively.

We shall describe hereinafter a preferred embodiment of the invention with reference to FIGS. 1, 2 and 4 to 8. The description given above of the aerial work platform of FIGS. 1 and 2 remains applicable in the context of the present embodiment.

As can be seen in FIGS. 1 and 2, the aerial work platform comprises an elongate chassis mounted on wheels to enable the aerial work platform to be moved. The two narrow ends define the front AV and the rear AR of the aerial work platform with respect to the direction of movement on the ground, which is conferred on the aerial work platform by two front wheels 4 and two rear wheels 5.

The aerial work platform comprises, on each lateral side, an anti-pothole bar 10. One of these two bars is visible in FIG. 2, where it is in the lowered position, whereas they are not visible in FIG. 1 since they are in the raised position under the chassis 1. Each side bar 10 is arranged under the chassis 1 and extends horizontally over substantially the entire length between the front wheel and the rear wheel, whether it be in the lowered position or in the raised position.

The system for actuating the bars 10 in order to move them into the lowered position and in the raised position will be described with reference to FIGS. 4 to 8.

Each bar 10 is secured, towards each of its longitudinal ends, to a support 21 that is mounted pivotably on the chassis 1 about a respective shaft 22. The bars 10 pass from the raised position to the lowered position and vice versa by pivoting about the shafts 22. Each bar 10 is moved between these two positions by a same actuator, in this case a hydraulic cylinder 30. This is allocated solely to the actuation of the bars 10. The body of the cylinder 30 is mounted in a pivot connection about a shaft 33 on a support 21 of one of the bars 10. In this case, the body of the cylinder 30 has been extended by a rod 32 that is arranged fixedly on the body of the cylinder 30. The rod 31 of the cylinder 30 is mounted in pivot connection about a shaft 34 on a support 21 of the other bar 10. In a variant, the rod 31 of the cylinder 30 and/or the body of the cylinder 30 are mounted—preferably in a pivot connection—directly on the corresponding bar 10 or on a part other than a support 21 to which the corresponding bar 10 is secured.

As can be seen in FIGS. 5 and 6, when the rod 31 emerges from the body of cylinder 30, the distance between the two shafts 33, 34 increases and causes each support 21 to pivot about its shaft 22 so as to move the bars 10 into the raised position. The pivoting of the bars 10 is stopped in the raised position by abutment at 40 against the chassis 1.

As can be seen in FIGS. 7 and 8, when the rod 31 retracts into the body of the cylinder 30, the distance between the two shafts 33, 34 decreases and causes each support 21 to pivot about its axis 22 in the opposite direction to the previous case, which causes the movement of the bars 10 into the lowered position. The pivoting of the bars 10 is stopped in the lowered position by abutment 41—visible only in FIGS. 6 and 8—against the chassis 1.

In a variant, the cylinder 30 may be mounted on the supports 21 so that it is the emergence of the rod 31 that causes the movement of the bars 10 into the lowered position and the retraction of the rod 31 that causes their movement 10 into the raised position.

As can be seen, the cylinder 30 extends horizontally and perpendicular to the longitudinal direction of the chassis 1, which limits the space necessary for the housing of the cylinder 30.

The cylinder 30 is solely held on the chassis by the supports 21 on which it is mounted, which simplifies the assembly operations.

The hydraulic supply to the cylinder 30 is effected through flexible pipes, which enables the body of the cylinder to move relative to the chassis 1 when the rod 31 emerges or retracts.

In our example, the cylinder 30 is a double-acting cylinder. It is supplied with hydraulic fluid by means of two couplings 36, 37 mounted in our example on a housing 35. The housing 35 is itself mounted on the body of the cylinder 30 by two rigid tubes each supplying chambers of the cylinder 30 from the couplings 36, 37 via a respective non-return valve contained in the housing 35. These non-return valves advantageously provide safety by locking the rod 31 of the cylinder 30 in position when it is not in movement or in the case where the hydraulic supply circuit were to fail.

For reasons of safety, a position sensor 50 is provided for each bar 10 in order the check whether it is in the lowered position. This makes it possible to trigger an alarm and prevent the movement on the ground of the aerial work platform if one of the bars 10 is not in the lowered position when it should be. In this case, each sensor 50 cooperates with a support surface 21 of the bar 10.

It is advantageous for the bottom edge 10*a* of the bars 10, when they are in the lowered position, to be offset towards the outside of the chassis with respect to a vertical line V passing through the pivot shaft 22 of the support 21. In this way, the forces $F_v$ external to the aerial work platform that are exerted vertically upwards on the bottom edge 10*a* of the bars 10 are countered directly by the chassis 1 at 41 where the bar 10 is in abutment. It is therefore not the cylinder 30 that counters the vertical forces. The same applies to the forces $F_{LI}$ external to the aerial work platform exerted laterally on the bars 10 in the direction of the outside of the chassis 1. On the other hand, the cylinder 30 counters the forces $F_{LE}$ external to the aerial work platform that are exerted laterally on the bars 10 towards the inside of the chassis 1. This is advantageous because the side forces $F_{LE}$ and $F_{LI}$ are generally lower than the vertical forces $F_v$, which makes it possible to use a less powerful and therefore less expensive cylinder 30.

In general terms, the system for actuating the bars 10 is preferentially sized so as to be able to hold the bars 10 in the lowered position for vertical forces $F_v$ exerted on each of them of at least half the weight of the aerial work platform with its work platform loaded to its maximum allowable load. Likewise, the system for actuating the bars 10 is preferentially sized so as to be able to hold the bars 10 in the lowered position for side forces $F_{LE}$, $F_{LI}$ exerted on each of them of at least one quarter of the weight of the aerial work platform with its work platform loaded to its maximum allowable load.

The cylinder 30 can be supplied by the hydraulic supply circuit of the aerial work platform that serves for the supply of the actuators of the lifting mechanism 2 and/or the actuators controlling the orientation of the steered wheels 4 of the aerial work platform. The cylinder may be conventionally controlled by a hydraulic directional control valve, preferably with electrical control. The directional control valve may then be controlled by an electrical circuit according for example to a position sensor—not shown—that detects whether the lifting mechanism 2 of the work platform 3 is in the lowered position and/or commands triggered by the operator at the control station of the aerial work platform.

There are several ways of managing the sequences of lowering and raising the bars 10. By way of example, the control circuit may cause the raising of the bars 10 in the case where a command for moving the aerial work platform on the ground is triggered by the operator and the aforementioned position sensor detects that the lifting mechanism 2 is in the lowered position. In the opposite direction, the control circuit may cause the lowering of the bars 10 in the case where a command to raise the work platform 3 is triggered by the operator. If the position sensor of the lifting mechanism indicates that the work platform 3 is raised and one of the position sensors 50 indicates that a bar is not in the lowered position, the control circuit prevents the movement on the ground of the aerial work platform and triggers an alert for the attention of the operator, for example by switching on a fault indicator light on the control station.

FIGS. 9 and 10 illustrate schematically a variant to the previously described embodiment. Only the left-hand part of the actuation system is shown, it being stated that the right-hand part not shown is implemented in the same way, except that it is the body of the cylinder 30 that is connected to the corresponding support 21 in the same way as the rod of the cylinder 31 for the left-hand part of the actuation system. We shall mention below only the differences in this variant compared with the previous embodiment. As before, the bars 10 are mounted in a pivot connection on the chassis about a shaft 22. On the other hand, the cylinder 30 actuates each bar 10 by means of a respective locking mechanism. It is formed in this example by two links 61 and 62. The link 61 is mounted in a pivot connection on the support 22 about the shaft 63. At its other end, the link 61 is mounted so as to pivot about the shaft 64 at one end of the link 62. The other end of the link 62 is mounted in a pivot connection on the chassis about the shaft 65. The rod 31 is connected in a pivot connection to the locking mechanism at the shaft 64.

FIG. 10 illustrates the unlocked position of the locking mechanism in which the links 61 and 62 are in a folded position while the bar 10 is raised. The cylinder 30 moves the locking mechanism and the bar 10 when it brings out its rod 31.

When the cylinder 30 retracts its rod 31, the latter moves the locking mechanism into the locked position that is illustrated by FIG. 9. In this case, the shaft 64 has passed beyond the position of alignment with the shafts 63, 65 and one of the links 61, 62 is in abutment against a stop 66 on the chassis 1. In this way, the links 61, 62 are in a self-locking position with respect to any force external to the aerial work platform exerted on the bar 10 that tends to make it pivot from the lowered position to the raised position. In other words, in the locked position, the locking mechanism counters these forces independently of the cylinder. Since the cylinder 30 does not act in the holding of the bar 10 in position vis-à-vis these forces, it may have an appreciably lower power since it must only be able to actuate the locking mechanisms. In this case, it is possible to replace the hydraulic cylinder 30 with a pneumatic cylinder, or even an electromechanical actuator.

Naturally, the present invention is not limited to the examples and embodiment described and depicted but is capable of numerous variants accessible to a person skilled in the art. The actuator may be of any suitable type other than a hydraulic cylinder. Although particularly suited to scissor-type aerial work platforms and vertical-mast aerial work platforms, the invention can be applied to any other type of mobile personnel elevating platforms, including aerial work platforms that are towed or pushed for moving them on the ground.

The invention claimed is:

1. An aerial work platform, comprising:

a chassis mounted on wheels for movement of the aerial work platform on the ground;

a work platform;

a lifting mechanism mounted on the chassis and supporting the work platform for moving it in height;

two side bars arranged under the chassis, each being able to move with respect to the chassis between:

a raised position; and a lowered position in which the side bar projects beyond the chassis in the direction of the ground; and a single actuator allocated to the actuation of the two side bars, wherein:

the actuator is allocated solely to the actuation of the two side bars and is adapted to move the two side bars from the raised position to the lowered position and vice versa, the actuator having two opposite ends through which it actuates the two side bars simultaneously by varying the distance between the two ends, and the actuator acts on each of the two side bars through a respective one of the two ends, the actuator being held only through the two ends.

2. The aerial work platform according to claim 1, in which:

each of the bars is mounted on the chassis through connection elements; and the actuator is held on the chassis solely through said connection elements.

3. The aerial work platform according to claim 1, in which the bars are mounted on the chassis in a pivoting connection.

4. The aerial work platform according to claim 1, in which when the side bars are in the lowered position, the actuator is configured to urge each side bar against a respective fixed stop of the chassis so each side bar stays in the lowered position.

5. The aerial work platform according to claim 4, in which the bars are mounted on the chassis in a pivoting connection about a pivot axis and in which, in the lowered position, a bottom edge of each bar is offset with respect to a vertical line passing through the pivot axis so that the forces external to the aerial work platform that are exerted vertically upwards on the bottom edge of the bar are countered by the respective fixed stop of the chassis.

6. The aerial work platform according to claim 1, in which when the side bars are in the raised position, the actuator further urges each side bar against a fixed stop of the chassis so each side bar stays in the raised position.

7. The aerial work platform according to claim 1, in which each bar is horizontal and extends between two side wheels substantially over the entire length separating the two side wheels.

8. The aerial work platform according to claim 1, in which the actuator is a cylinder or a hydraulic cylinder.

9. The aerial work platform according to claim 8, in which the cylinder extends horizontally and perpendicular to a longitudinal direction of the chassis.

10. The aerial work platform according to claim 1, in which the actuator opposes forces external to the aerial work platform acting on the bars that tend to move them from the lowered position to the raised position.

11. The aerial work platform according to claim 1, in which each of the two ends of the actuator is mounted on a respective one of the two bars or on a respective part on which a respective one of the two bars is secured.

12. The aerial work platform according to claim 1, in which each of the two ends of the actuator is mounted in a pivot connection on a respective support to which a respective one of the two side bars is secured, the support being mounted pivotably on the chassis.

13. The aerial work platform according to claim 12, in which each of the side bars has two longitudinal ends, each of the side bars being secured to the respective support towards one of the longitudinal ends of the side bar, each of the side bars further being secured towards the other of the longitudinal ends of the side bar to a second respective support mounted pivotably on the chassis.

14. The aerial work platform according to claim 1, in which the actuator actuates each of the two side bars through a respective locking mechanism, each locking mechanism having an unlocked position and a locked position, the actuator actuating the locking mechanisms for making them pass from their unlocked position to their locked position and vice versa, the passage to the unlocked position having the effect of moving the side bars into the raised position and the passage into the locked position having the effect of moving the bars into the lowered position, the locking mechanisms in the locked position countering, independently of the actuator, any force external to the aerial work platform exerted on the bars that tend to move them from the lowered position to the raised position.

15. The aerial work platform according to claim 1, which is a scissor-type aerial work platform or a vertical-mast aerial work platform.

16. An aerial work platform, comprising:

a chassis mounted on wheels for movement of the aerial work platform on the ground;

a work platform;

a lifting mechanism mounted on the chassis and supporting the work platform for moving it in height;

two side bars arranged under the chassis and mounted on the chassis in a pivoting connection, each bar being horizontal and extending between two side wheels substantially over the entire length separating the two side wheels and each bar being able to pivot with respect to the chassis between:

a raised position; and a lowered position in which the side bar projects beyond the chassis in the direction of the ground; and a single cylinder allocated to the actuation of the two side bars, wherein:

the cylinder is allocated solely to the actuation of the two side bars for moving them from the raised position to the lowered position and vice versa, the cylinder having two opposite ends through which it actuates the two side bars simultaneously by varying the distance between the two ends, the cylinder extends horizontally and perpendicular to a longitudinal direction of the chassis, and the cylinder acts on each of the two side bars through a respective one of the two ends, the cylinder being held only through the two ends.

17. The aerial work platform according to claim 16, wherein each of the two ends of the cylinder is mounted on a respective one of the two bars or on a respective part on which a respective one of the two bars is secured.

18. The aerial work platform according to claim 16, in which the cylinder actuates each of the two side bars through a respective locking mechanism, each locking mechanism having an unlocked position and a locked position, the cylinder actuating the locking mechanisms for making them pass from their unlocked position to their locked position and vice versa, the passage to the unlocked position having the effect of moving the side bars into the raised position and the passage into the locked position having the effect of moving the bars into the lowered position, the locking mechanisms in the locked position countering, independently of the cylinder, any force external to the aerial work platform exerted on the bars that tend to move them from the lowered position to the raised position.

19. An aerial work platform, comprising:

a chassis mounted on wheels for movement of the aerial work platform on the ground;

a work platform;

a lifting mechanism mounted on the chassis and supporting the work platform for moving it in height;

two side bars arranged under the chassis, each side bar on a respective one of two opposite sides of the chassis, the two side bars being mounted on the chassis in a pivoting connection about a respective pivot axis, each bar being horizontal and extending between two respective side wheels substantially over the entire length separating the two side wheels and each side bar being able to pivot with respect to the chassis between:

a raised position; and a lowered position in which the side bar projects beyond the chassis in the direction of the ground; and a single cylinder allocated to the actuation of the two side bars, the cylinder comprising a cylinder body and a cylinder rod capable of retracting into the cylinder body and of emerging from the cylinder body, wherein:

the cylinder is allocated solely to the actuation of the two side bars for moving them from the raised position to the lowered position and vice versa, the cylinder having two opposite ends through which is actuated the two side bars simultaneously by varying the distance between the two ends, the cylinder extends horizontally and perpendicular to a longitudinal direction of the chassis, said cylinder body and said cylinder rod are mounted in a pivot connection on a respective one of the two side bars or on a respective part on which a respective one of the two side bars is secured, the cylinder opposes forces external to the aerial work platform acting on the bars that tend to move them from the lowered position to the raised position, when the side bars are in the lowered position, the cylinder is configured to urge each bar in the lowered position against a respective first abutment of the chassis so each side bar stays in the lowered position, and in the lowered position, a bottom edge of each side bar is offset with respect to a vertical line passing through the pivot axis so that the forces external to the aerial work platform that are exerted vertically upwards on the bottom edge of the side bar are countered by the respective first abutment of the chassis.

20. The aerial work platform according to claim 19, in which when the side bars are in the raised position, the cylinder further urges the side bars against a second abutment of the chassis so each side bar stays in the raised position.

* * * * *